US011565846B1

(12) United States Patent
Sines

(10) Patent No.: US 11,565,846 B1
(45) Date of Patent: Jan. 31, 2023

(54) ROTATABLE BEVERAGE CAN COVER

(71) Applicant: Randy D. Sines, Tucson, AZ (US)

(72) Inventor: Randy D. Sines, Tucson, AZ (US)

( * ) Notice: Subject to any disclaimer, the term of this patent is extended or adjusted under 35 U.S.C. 154(b) by 0 days.

(21) Appl. No.: 17/377,741

(22) Filed: Jul. 16, 2021

(51) Int. Cl.
*B65D 17/28* (2006.01)

(52) U.S. Cl.
CPC .. *B65D 17/4014* (2018.01); *B65D 2517/0025* (2013.01); *B65D 2517/0041* (2013.01)

(58) Field of Classification Search
CPC ..... A47G 19/2211; A47G 19/2216; B65D 17/4014; B65D 17/4012; B65D 17/401
USPC ..... 220/730, 713, 718, 716, 711, 703, 694, 220/273, 272, 270, 269, 266, 265, 906; D9/447, 435, 443, 450, 449
See application file for complete search history.

(56) References Cited

U.S. PATENT DOCUMENTS 3,362,572 A * 1/1968 Pelley ..... B65D 17/4012 D9/438
3,967,752 A * 7/1976 Cudzik ..... B65D 17/4012 220/269
4,852,763 A 8/1989 Dimberio
5,402,904 A * 4/1995 Close ..... B65D 51/007 220/717
5,813,559 A 9/1998 Ho Cho
5,823,384 A * 10/1998 Sartori de Zamparolo ..... B65D 25/48 220/717
6,073,797 A * 6/2000 Barous ..... B65D 43/0212 220/780
6,443,323 B1 9/2002 De Rose
6,637,616 B2 * 10/2003 Couto ..... B65D 47/06 220/717
6,910,598 B2 6/2005 Gotz
2007/0095847 A1 * 5/2007 Gruver ..... B65D 17/4012 220/780
2011/0108561 A1 * 5/2011 Bonin ..... B65D 51/20 220/718

(Continued)

FOREIGN PATENT DOCUMENTS

CA 2016721 A1 * 12/1990 ..... B65D 45/00
CN 201484756 U * 5/2010 ..... B65D 17/34
DE 202020102810 U1 * 7/2020 ..... B65D 17/28

(Continued)

*Primary Examiner* — Robert J Hicks
(74) *Attorney, Agent, or Firm* — Newman Law, LLC

(57) ABSTRACT

The Rotatable Beverage Can Cover (200) enables a beverage drinker of a stay-on-tab beverage can (100) to drink the beverage (600) without being subjected to unsanitary lid surface conditions . The Rotatable Beverage Can Cover (200) comprises a circular surface (210), a curved side wall (300) and a notch (500). The Rotatable Beverage Can Cover (200) is fastened to the stay-on-tab beverage can (100) and placed in its "sanitary protection" position so that: a) the Rotatable Beverage Can Cover (200) covers the drinking contact area (190) and b) the notch (500) on the Rotatable Beverage Can Cover (200) allows access to the pull tab area (195). The beverage drinker rotates the Rotatable Beverage Can Cover (200) to move the Rotatable Beverage Can Cover (200) from its "sanitary protection" position to its"drinking access" position so that: a) the circular surface (210) of the Rotatable Beverage Can Cover (200) covers the pull tab area (195): and b) the notch (500) allows access to the drinking contact area (190) and the scored opening (126).

10 Claims, 12 Drawing Sheets

(56) References Cited

U.S. PATENT DOCUMENTS

| | | | | |
|---|---|---|---|---|
| 2013/0221005 | A1 | 8/2013 | Raymond | |
| 2021/0394956 | A1 * | 12/2021 | Latos | B65D 17/4014 |

FOREIGN PATENT DOCUMENTS

| | | | | | |
|---|---|---|---|---|---|
| JP | 2004083029 | A * | 3/2004 | | B65D 25/38 |
| WO | WO-9639334 | A1 * | 12/1996 | | B65D 17/4012 |

* cited by examiner

ROTATABLE BEVERAGE CAN COVER

(C) STATEMENT REGARDING FEDERALLY SPONSORED RESEARCH/DEVELOPMENT

Not Applicable

(B) CROSS-REFERENCE TO RELATED APPLICATIONS

Not Applicable

(D) The Names Of The Parties To A Joint Research Agreement

Not Applicable (E) Reference To A "Sequence Listing," A Table, Or A Computer Program Not Applicable (F) Statement Regarding Prior Disclosures By An Inventor Or Joint Inventor Not Applicable

(G) BACKGROUND OF THE INVENTION

(G) 1 Field Of Invention

The Rotatable Beverage Can Cover (200) fastens to a double seamed ridge (122) formed by a lid (120) and a beverage can body (110) of a stay-on-tab beverage can (100), providing sanitary protection to the drinking contact area (190)— the area of the stay-on-tab beverage can (100) that a beverage drinker's mouth touches while drinking a beverage (600) stored within the stay-on-tab beverage can (100).

(G) 2 Beverage Can Description

A beverage can is a metal drink container designed to hold the beverage (600) such as carbonated soft drinks, alcoholic drinks, fruit juices, teas, herbal teas, energy drinks, etc. Beverage cans are made of aluminum (75% of worldwide production) or tin-plated steel (25% of worldwide production). Worldwide production for all drink cans currently exceeds 370 billion cans per year.

The world's beer and soda consumption consists of about 180 billion aluminum beverage cans every year. This is 6,700 beverage cans every second - enough to go around the planet every 17 hours.

Aluminum beverage cans compete successfully against drink containers of glass, plastic, and steel, and are the only drink containers for which closed loop recycling applies; a used aluminum beverage can is recycled back into aluminum beverage can sheet for the manufacture of another aluminum beverage can.

The usability and popularity of the stay-on-tab beverage can (100) arises from consumer ease of use and manufacturing mass production efficiencies from its design and aluminum characteristics. The stay-on-tab beverage can (100) comprises of two main parts: the beverage can body (110) and the lid (120). FIG. 8 shows a stay-on-tab beverage can (100) with the beverage can body (110) and the lid (120).

The top of the beverage can body (110) and the perimeter of the lid (120) are both bent and seamed together to form a double seamed ridge (122), which secures the lid (120) to the beverage can body (110). FIG. 6 shows the double seamed ridge (122) securing the lid (120) to the beverage can body (110).

A rivet (140) integral to the lid (120) fastens a pull tab (130) to the lid (120). FIG. 9 shows the pull tab (130) fastened to the lid (120) by the rivet (140). The pull tab (130) lies over the lid (120) prior to use—"prone" position. FIG. 7 shows the pull tab (130) in the "prone" position. The lid (120) has a scored area (124) in front of the the pull tab (130). FIG. 9 shows the scored area (124) of the lid (120). When the pull tab (130) is pulled to an "extended" position, the pull tab (130) pushes the scored area (124) into the stay-on-tab beverage can (100), creating a scored opening (126). The scored area (124) comes into contact with the beverage (600). FIG. 8 shows the pull tab (130) in its "extended" position, having pushed down the scored area (124) and creating a scored opening (126).

The area where a beverage drinker places his or her lips to drink the beverage (600) from the stay-on-tab beverage can (100) is defined as the drinking contact area (190). FIG. 12 shows the drinking contact area (190) of the stay-on-tab beverage can (100).

The area where the pull tab (130) lies under the lid (120) in its "prone" position is defined as the pull tab area (195). FIG. 12 shows the pull tab area (195) of the stay-on-tab beverage can (100).

(G) 3 Lack of Sanitary Safety

The features of the stay-on-tab beverage can (100) that allow for convenient beverage drinking also make the stay-on-tab beverage can (100) prone to airborne and touch contamination prior to use by the beverage drinker. The open access to the lid (120) and the pull tab (130) also allow for airborne and touch contaminants to accumulate over the beverage can body (110) and the lid (120), either by atmospheric exposure or handling from individuals during shipping, storage, display, and/or purchase. These airborne and touch contaminants are especially problematic on the drinking contact area (190) of the stay-on-tab beverage can (100).

Contamination can also occur when the scored area (124) is pushed down into the beverage (600) by the pull tab (130). Any contamination layered over the scored area (124) could potentially be washed into the beverage (600). Furthermore, any time the beverage (600) is poured out of the stay-on-tab beverage can (100), the beverage (600) can be in contact with any contamination layered over the scored area (124) and either directly imbibed by the beverage drinker or poured into a glass or cup to be imbibed later.

While there has been a myriad of drinking can developments over the past half century, one thing noticeably missing is a concern for "sanitization" safety for a beverage can consumer. With the various type of "pop top" openings, 99.99% of the time, a consumer covers much of the top and side of the can with his/her lips, surfaces that are rarely sanitized. The cans are subject to numerous contamination points from the factory, warehouses, distributors, sellers, convenience stores, grocery stores, machine dispensers, bars, restaurants and so forth where these top and side surface drinking areas can be contaminated and germ laden. A limited amount of people "may" wipe the can with their hand, napkin, clothes, cloth, etc. but rarely to the degree that potentially lethal viruses such as COVID-19 would be neutralized.

Solutions for this problem "could" be for manufacturers to sanitize the outer surface of the stay-on-tab beverage cans (100) and/or to cover the stay-on-tab beverage can (100)

with some sort of "shrink wrap" protective cover; however, this solution would not only add considerable cost but also create the problem of people littering the protective covers after removal. This littering was a huge problem for the original "pop-tops" that were just pulled off and tossed. There are a myriad of patents and patent applications with "partial" solutions to the problem but none that meet the criteria of can manufacturers to be neither overly costly nor complex to interfere with introducing into a production line. Furthermore, these patents and patent applications do not address the usage of such technology as an "aftermarket" product to "fasten on" a beverage can after purchase.

(G) 4 Shortcomings of Stay-On-Tab Beverage Cans (100)

To solve this airborne and touch contaminant issue, a variety of beverage can lid covers have been developed, but none have achieved commercial adoption by beverage companies.

First, prior art stay-on-tab beverage can (100) lid covers are not compatible with the current manufacturing process of stay-on-tab beverage cans (100). The manufacturing of stay-on-tab beverage cans (100) is a complex series of finely engineered and optimized steps that involve large custom manufacturing tooling. For a beverage can lid cover or any other add-on to be successful, this added step cannot significantly alter the way a stay-on-tab beverage can (100) is manufactured as it would require extensive re-tooling and process changes. A beverage can lid cover needs to be fastened to the lid of a stay-on-tab beverage can (100) as a process step that does not disrupt the overall manufacturing process. Otherwise, it would be very hard to justify such changes. Most likely, a beverage can lid cover would be fastened to the lid (120) of a stay-on-tab beverage can (100) as a final process step; particularly in light of the fact that traditionally, the lid (120) is fastened to the stay-on-tab beverage can (100) after beverage filling.

Second, prior art stay-on-tab beverage can (100) lid covers are complex to manufacture and add costs that are orders of magnitude more expensive than the actual beverage can. The design and engineering of these prior art stay-on-tab beverage can (100) lid covers are not compatible with the economics of the beverage can lids; they are not simple to manufacture and they do not use inexpensive materials compatible with rolled aluminum economics.

Third, traditional beverage can design and prior art can lid covers do not protect the integrity of the pull tab (130) to the lid (120). When a beverage drinker opens a stay-on-tab beverage can (100), the pull tab (130) is left in an "extended" position in a weakened structural state. More often than not, given its weakened structural state, the pull tab (130) breaks off from the rivet (140), leaving the beverage drinker to dispose of the pull tab (130), often by littering.

Fourth, prior art covers lack structural elements that allow for better gripping and easier rotation of the lid cover around the lid (120). Slippery surfaces due to moisture or smooth surface design prevent proper gripping, limiting the rotation of the lid (120). This lid rotation limitation causes inconvenience to the beverage drinker, beverage spillage, or failure to access the beverage for consumption.

(G) 5 Technical Issues

As seen in the prior art, a suitable beverage cover that minimizes contamination issues has not been developed. The following qualities are needed in a beverage cover for these contamination issues to be addressed:

1. Easy integration into beverage can manufacturing process
2. Easy and inexpensive manufacturing
3. Protection of pull tab integrity to the lid
4. Grip for improved rotation motion and handling (H) BRIEF SUMMARY OF THE INVENTION The Rotatable Beverage Can Cover (200) keeps the drinking contact area (190) of the lid (120) of a stay-on-tab beverage can (100) protected from airborne and touch contaminants prior to use by the beverage drinker. The Rotatable Beverage Can Cover (200) comprises a circular surface (210), a curved side wall (300), and a notch (500). The Rotatable Beverage Can Cover (200) may further comprise a protective conical ring (400).

The Rotatable Beverage Can Cover (200) fastens to a double seamed ridge (122) formed by a lid (120) and a beverage can body (110) of a stay-on-tab beverage can (100), providing sanitary protection to the area of the stay-on-tab beverage can (100) that a beverage drinker's mouth touches while drinking the beverage (600) from the stay-on-tab beverage can (100)—the drinking contact area (190). FIG. 7 shows the circular surface (210) of the Rotatable Beverage Can Cover (200) covering and protecting the drinking contact area (190).

In its initial "sanitary protection" position, the circular surface (210) of the Rotatable Beverage Can Cover (200) covers the drinking contact area (190) and the notch (500) of the Rotatable Beverage Can Cover (200) allows access to the pull tab area (195). The drinking contact area (190) includes the scored area (124) that will be pushed into the stay-on-tab beverage can (100) when the user pulls the pull tab (130) and the area that will be touched by the beverage drinker's lips when drinking the beverage (600) contained within the stay-on-tab beverage can (100). FIG. 7 shows the Rotatable Beverage Can Cover (200) in its "sanitary protection" position, where the circular surface (210) covers the drinking contact area (190).

To open the stay-on-tab beverage can (100), the beverage drinker pulls the pull tab (130), moving the pull tab (130) from its "prone" position to its "extended" position; the pull tab (130) pushes down the scored area (124), creating a scored opening (126). FIG. 8 shows the stay-on-tab beverage can (100) with a scored opening (126). The Rotatable Beverage Can Cover (200) is rotated from the initial "sanitary protection" position, either clockwise or counterclockwise to the "drinking access" position so that: a) the circular surface (210) of the Rotatable Beverage Can Cover (200) covers the pull tab area (195) and b) the notch (500) allows access to the drinking contact area (190) and the scored opening (126). FIG. 6 shows the Rotatable Beverage Can Cover (200) in its "drinking access" position, where the notch (500) allows access to the scored opening (126).

The notch (500) on the Rotatable Beverage Can Cover (200) allows access to the lid (120), either to the pull tab area (195) or the drinking contact area (190), depending on the position of the Rotatable Beverage Can Cover (200).

To allow for the Rotatable Beverage Can Cover (200) to rotate co-axially around the stay-on-tab beverage can (100), the lip (330) of the curved side wall (300) fastens underneath the double seamed ridge (122) of the lid (120). FIG. 12 shows the lip (330) fastened underneath the double seamed ridge (122) of the lid (120). The lip (330) guides the co-axial rotation of the Rotatable Beverage Can Cover (200) around the stay-on-tab beverage can (100). The interface between the double seamed ridge (122) of the lid (120) and the lip (330) of the curved side wall (300) creates a natural "drag" (friction) that moderates the rotation of the Rotatable Beverage Can Cover (200) around the stay-on-tab beverage can (100).

(I) BRIEF DESCRIPTION OF THE SEVERAL VIEWS OF THE DRAWING

Figure 6:
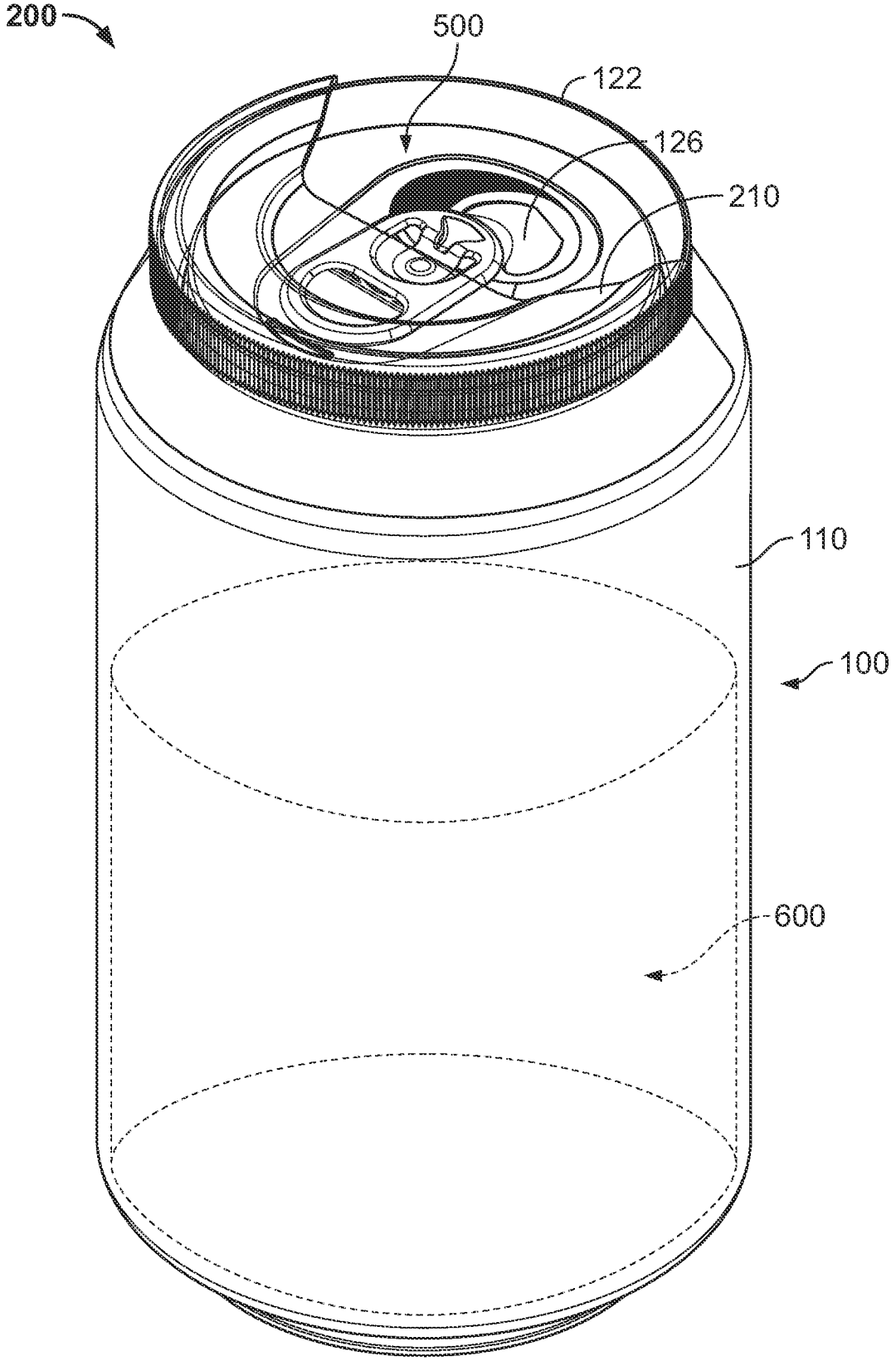

FIG. 6 shows a back left perspective view of the Rotatable Beverage Can Cover (200) fastened to the double seamed ridge (122) of the stay-on-tab beverage can (100), where the Rotatable Beverage Can Cover (200) is in the "drinking access" position. The stay-on-tab beverage can (100) is open; the pull tab (130) is in its "extended" position and has created a scored opening (126) from the scored area (124).

Figure 7:
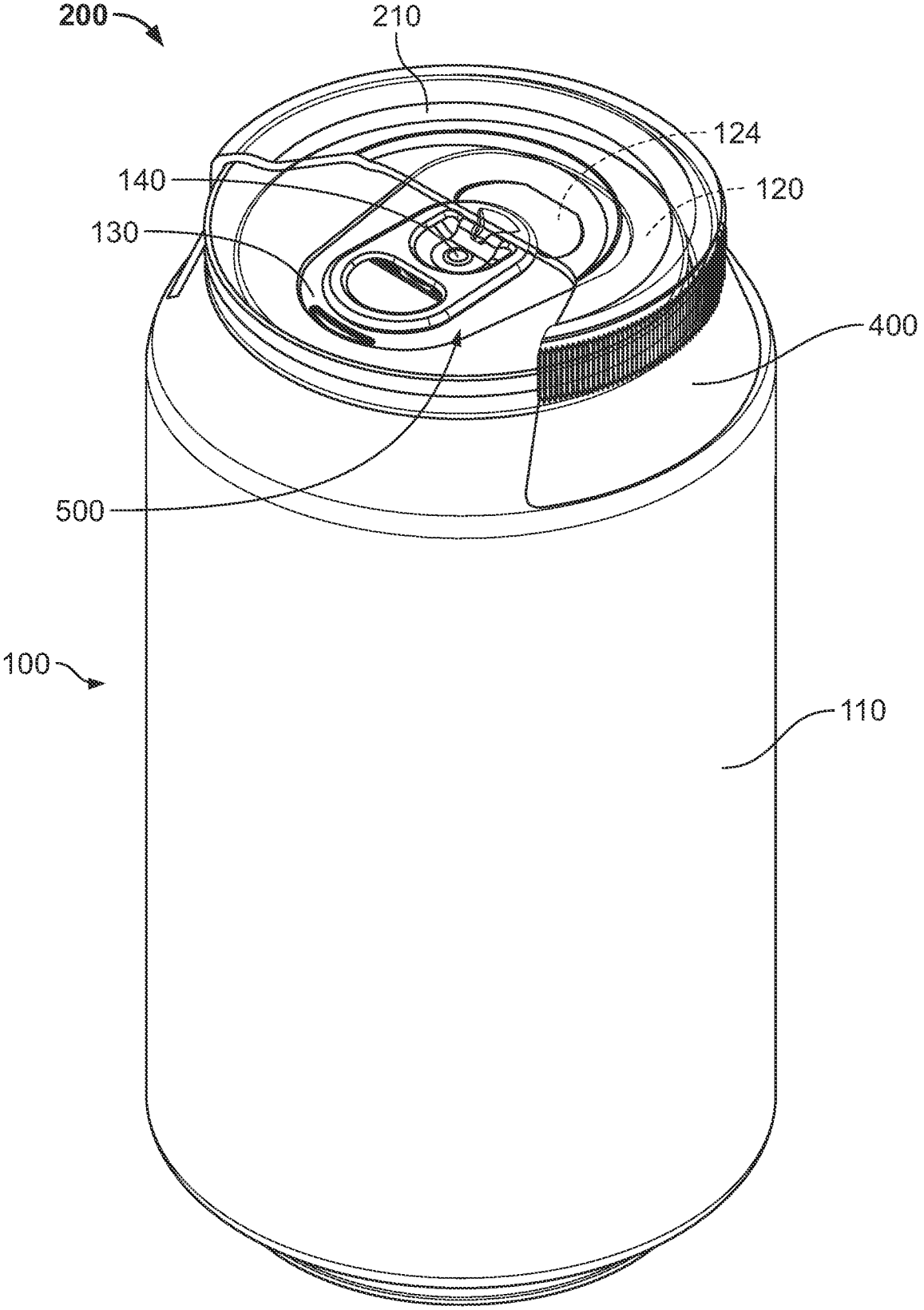

FIG. 7 shows a back left perspective view of the Rotatable Beverage Can Cover (200) fastened over the lid (120) of the stay-on-tab beverage can (100), where the Rotatable Beverage Can Cover (200) is in the "sanitary protection" position. The stay-on-tab beverage can (100) is closed.

Figure 8:
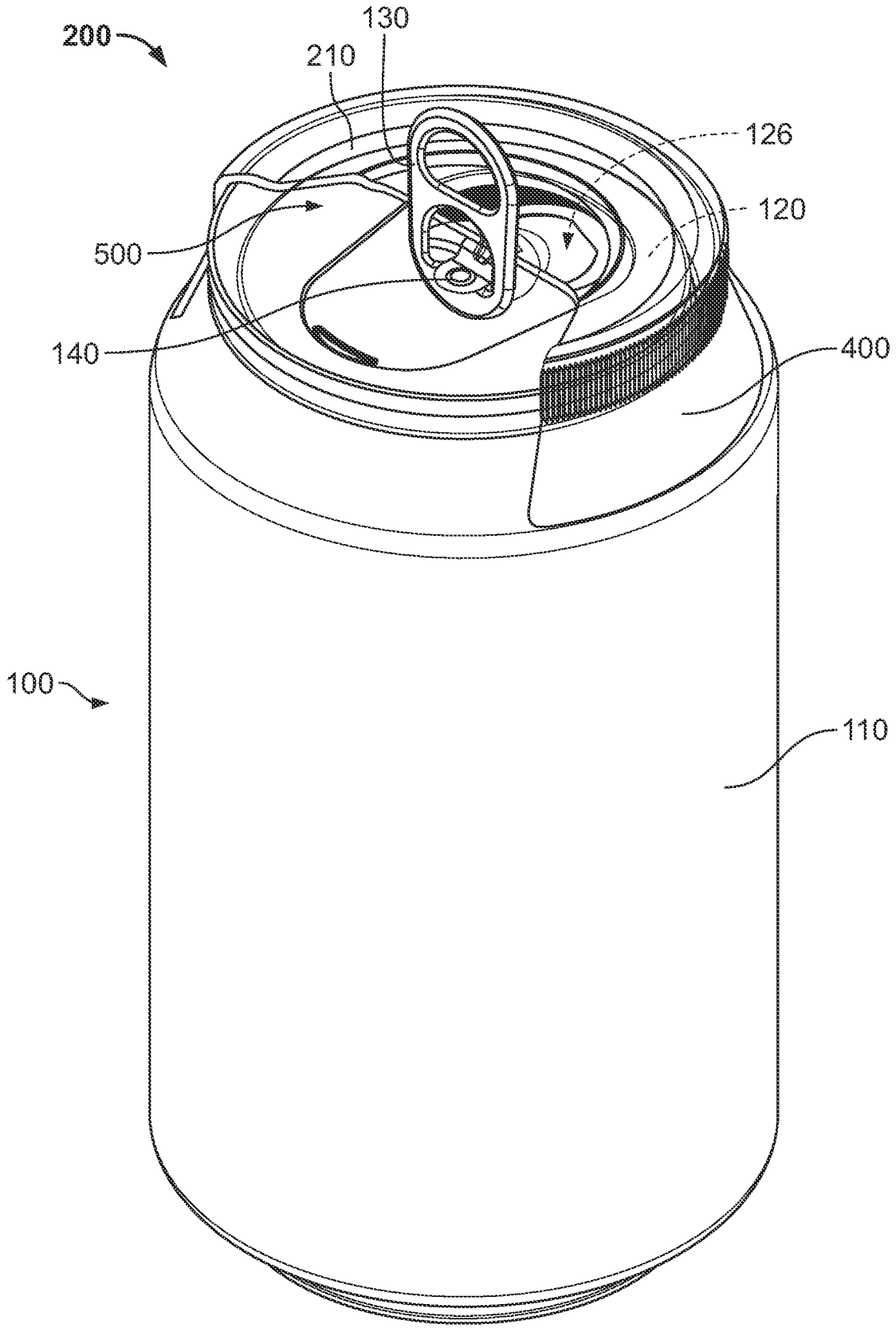

FIG. 8 shows a back left perspective view of the Rotatable Beverage Can Cover (200) fastened over the lid (120) of the stay-on-tab beverage can (100), where the Rotatable Beverage Can Cover (200) is in the "sanitary protection" position. The stay-on-tab beverage can (100) is open and the pull tab (130), in its "extended" position, has created a scored opening (126) from the scored area (124).

Figure 9:
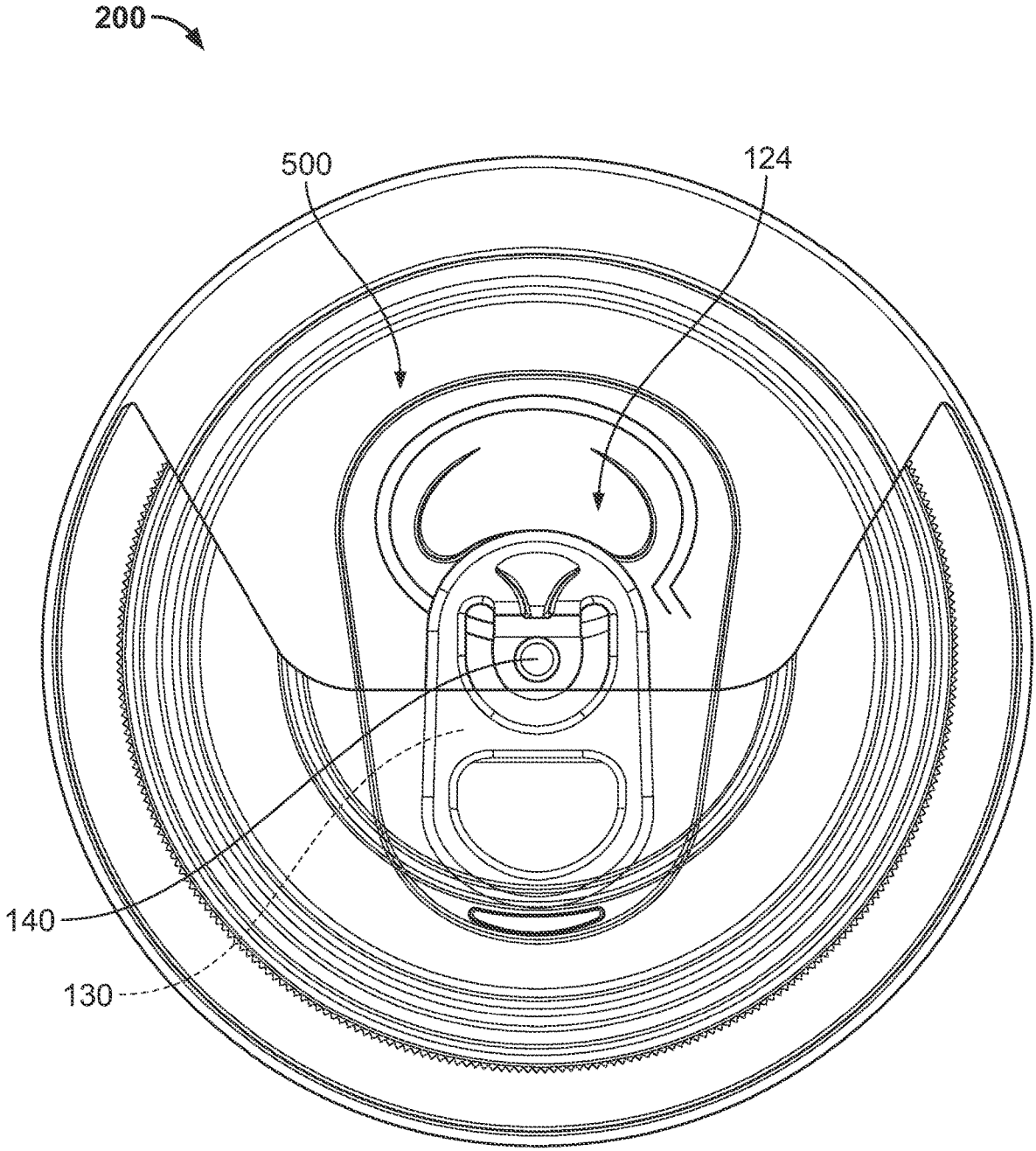

FIG. 9 shows a top view of the Rotatable Beverage Can Cover (200) fastened over the lid (120) of a stay-on-tab beverage can (100), where the Rotatable Beverage Can Cover (200) is in the "drinking access" position. The stay-on-tab beverage can (100) is closed.

Figure 10:
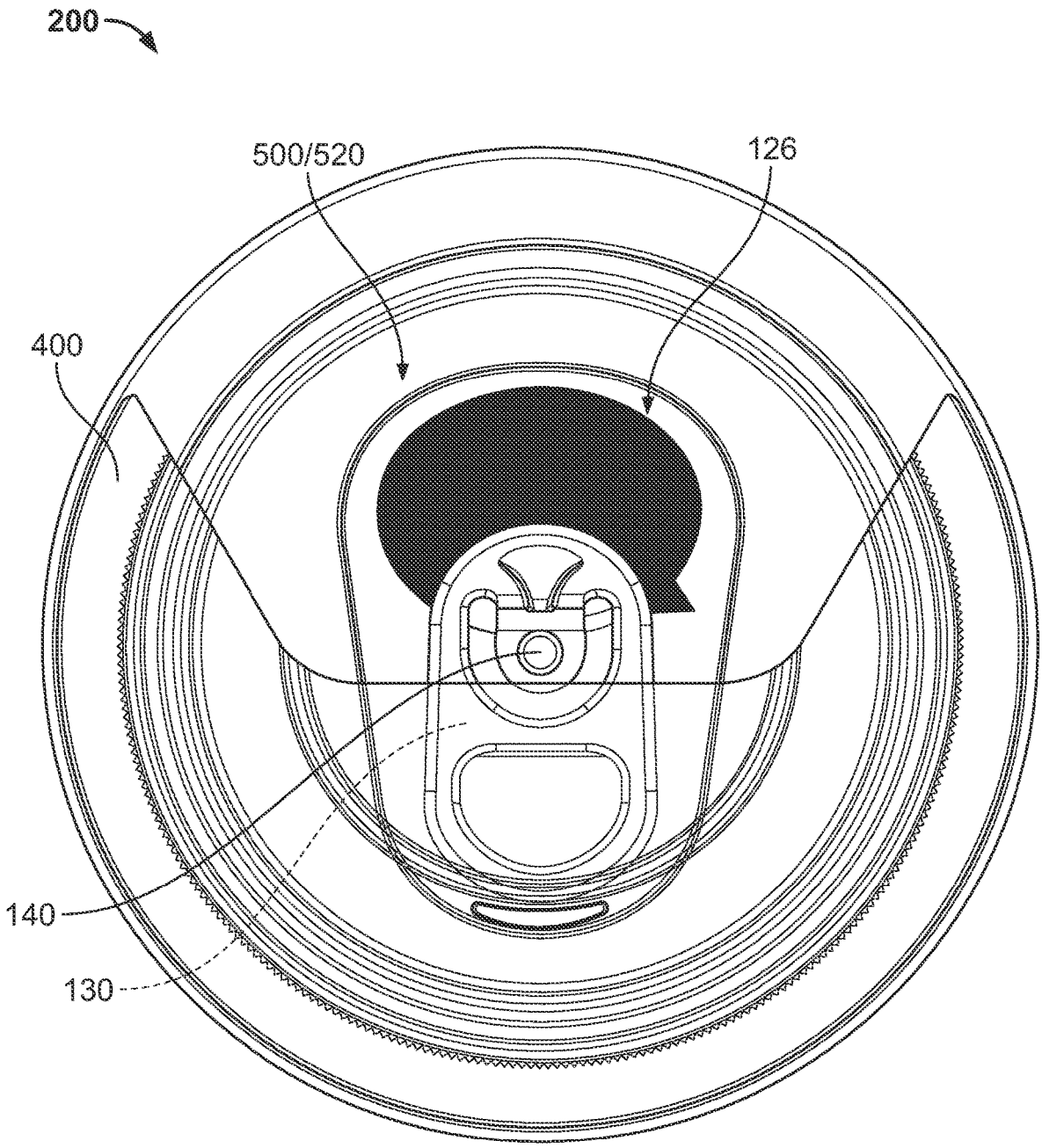

FIG. 10 shows a top view of the Rotatable Beverage Can Cover (200) fastened over the lid (120) of a stay-on-tab beverage can (100), where the Rotatable Beverage Can Cover (200) is in the "drinking access" position. The stay-on-tab beverage can (100) is open and the pull tab (130) lies below the circular surface (210) of the Rotatable Beverage Can Cover (200).

Figure 11:
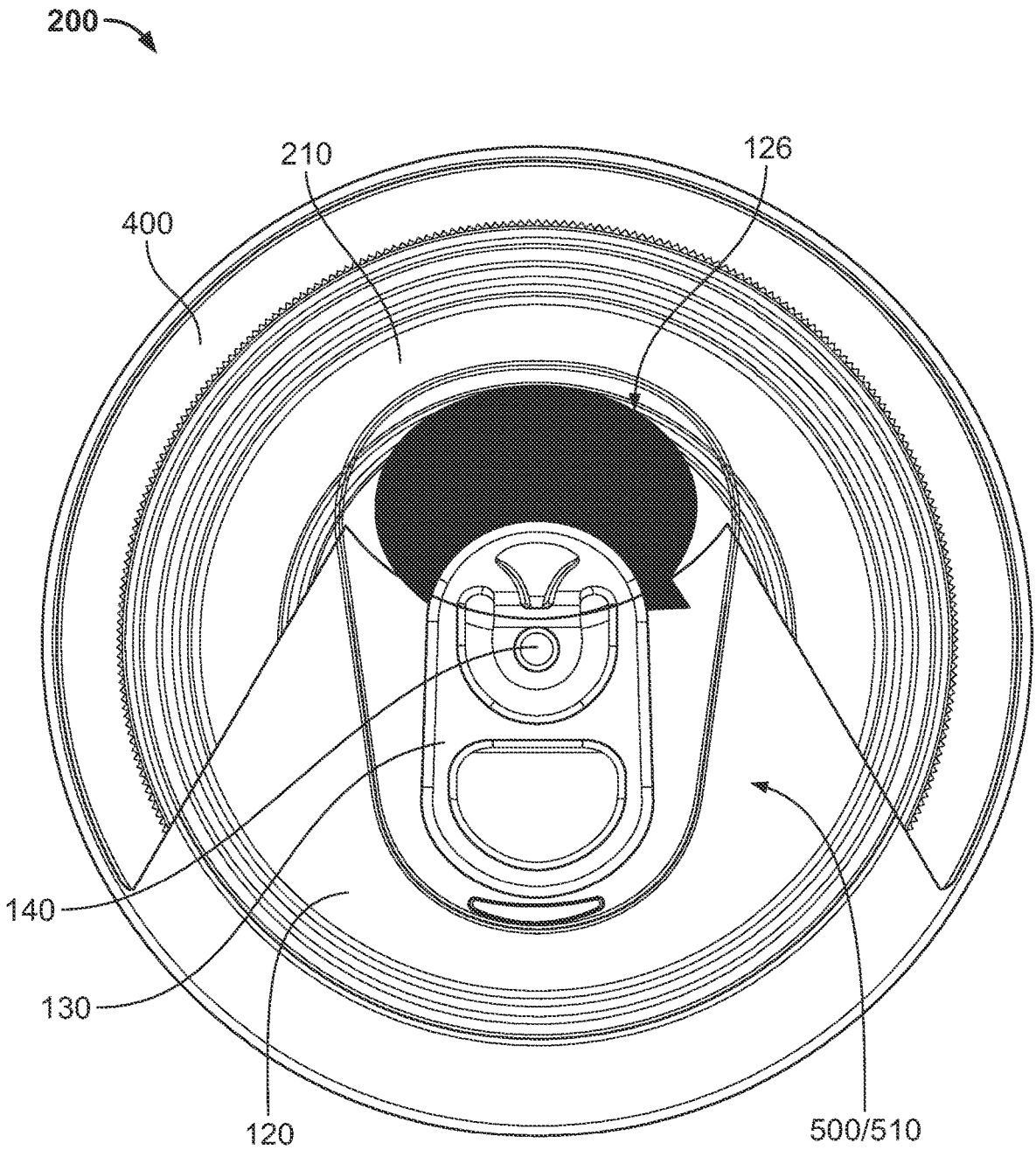

FIG. 11 shows a top view of the Rotatable Beverage Can Cover (200) fastened over the lid (120) of a stay-on-tab beverage can (100), where the Rotatable Beverage Can Cover (200) is in the "sanitary protection" position. The stay-on-tab beverage can (100) is open and the scored opening (126) lies below the circular surface (210) of the Rotatable Beverage Can Cover (200).

Figure 12:
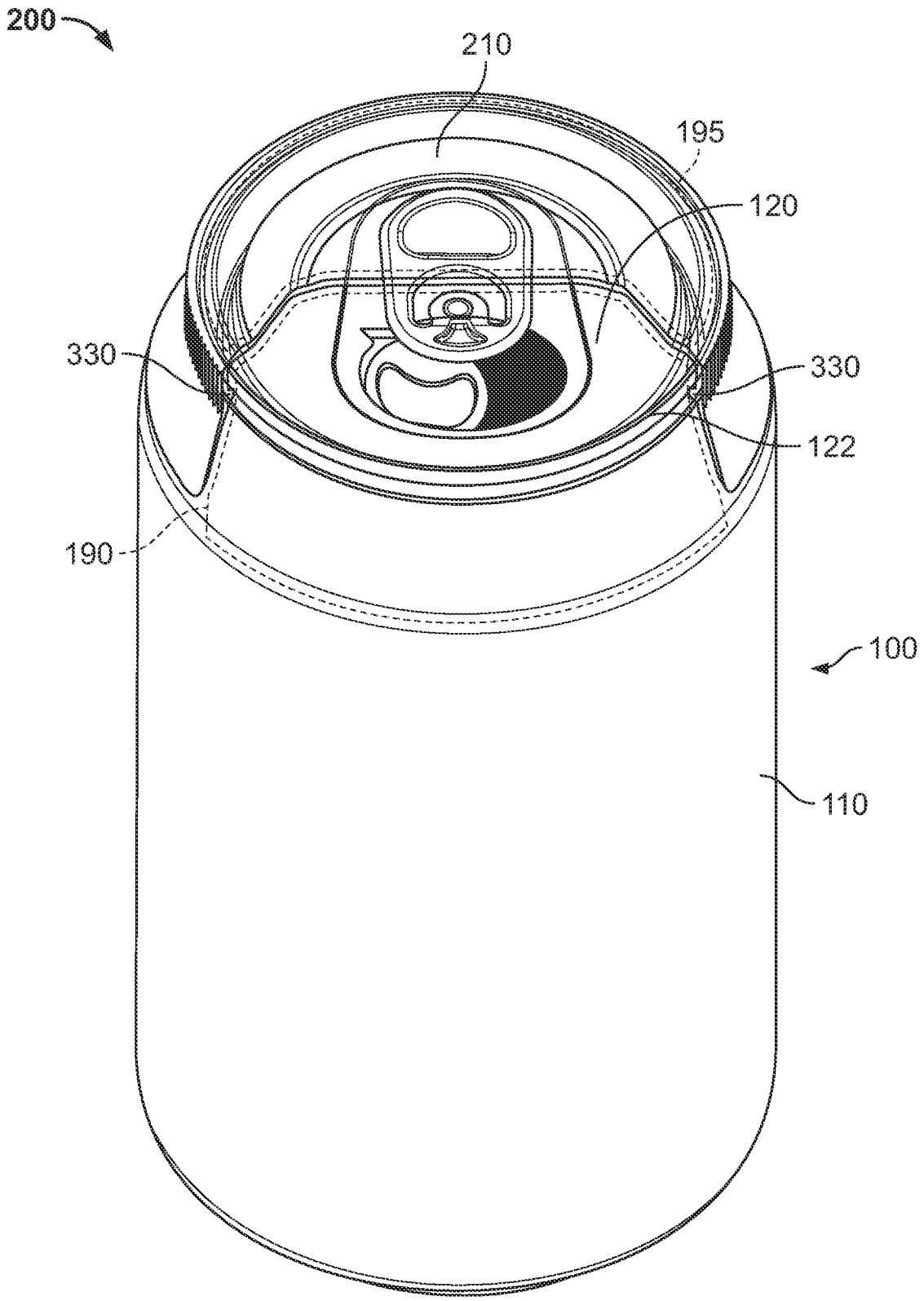

FIG. 12 shows a front perspective view of the Rotatable Beverage Can Cover (200) fastened over the lid (120) of a stay-on-tab beverage can (100), where the Rotatable Beverage Can Cover (200) is in the "drinking access" position. The stay-on-tab beverage can (100) is open and the pull tab (130) lies below the circular surface (210) of the Rotatable Beverage Can Cover (200).

(J) DETAILED DESCRIPTION OF THE INVENTION

(J) 1 Concept Description

The Rotatable Beverage Can Cover (200) enables a beverage drinker of a stay-on-tab beverage can (100) to drink a beverage (600)—soda pop, beer, etc.—without being subjected to unsanitary stay-on-tab beverage can (100) surfaces that subjects the beverage drinker to potential germ/disease exposure while drinking the beverage (600).

The Rotatable Beverage Can Cover (200) has at least one significant feature; the "entire" area of the stay-on-tab beverage can (100) which a beverage drinker's lips touches—the drinking contact area (190)—has been "shielded" to keep this drinking area hygienically clean until the time of use. Simply speaking, the lips of the beverage drinker will no longer be in contact with contaminated surfaces, potentially deadly. No other prior art on or off the market has provided this kind of "total" coverage and maintain the preferred features of the Rotatable Beverage Can Cover (200). The Rotatable Beverage Can Cover (200) preferred features include:

1. Fastens on any standard beverage can, thus does not require retooling by manufacturers and essentially becomes a part of the original beverage can
2. Inexpensive to manufacture yet functional (Target cost a fraction of a cent)
3. Likely to be made from a clear plastic (or opaque)
4. Manufactured for retention on the stay-on-tab beverage can (100) after usage to ensure disposal along with the stay-on-tab beverage can (100), eliminating littering environmental issues after use
5. Easy and quick operation
6. Rotates to uncover the drinking contact area (190), including the lower part of the pull tab (130) and the scored area (124) pushed into the beverage (600)
7. Drinking contact area (190) is 100% covered and protected, including the lower part of the pull-tab and the scored area (124) that is pushed into the beverage (600)
8. May rotate back to cover drinking contact area (190) in the event the beverage (600) is partially used
9. Readily accepted by consumer
10. Fastens on at factory for a consolidated unit but "could" fasten on and off for potential aftermarket application

(J) 2 Part Description

Figure 1:
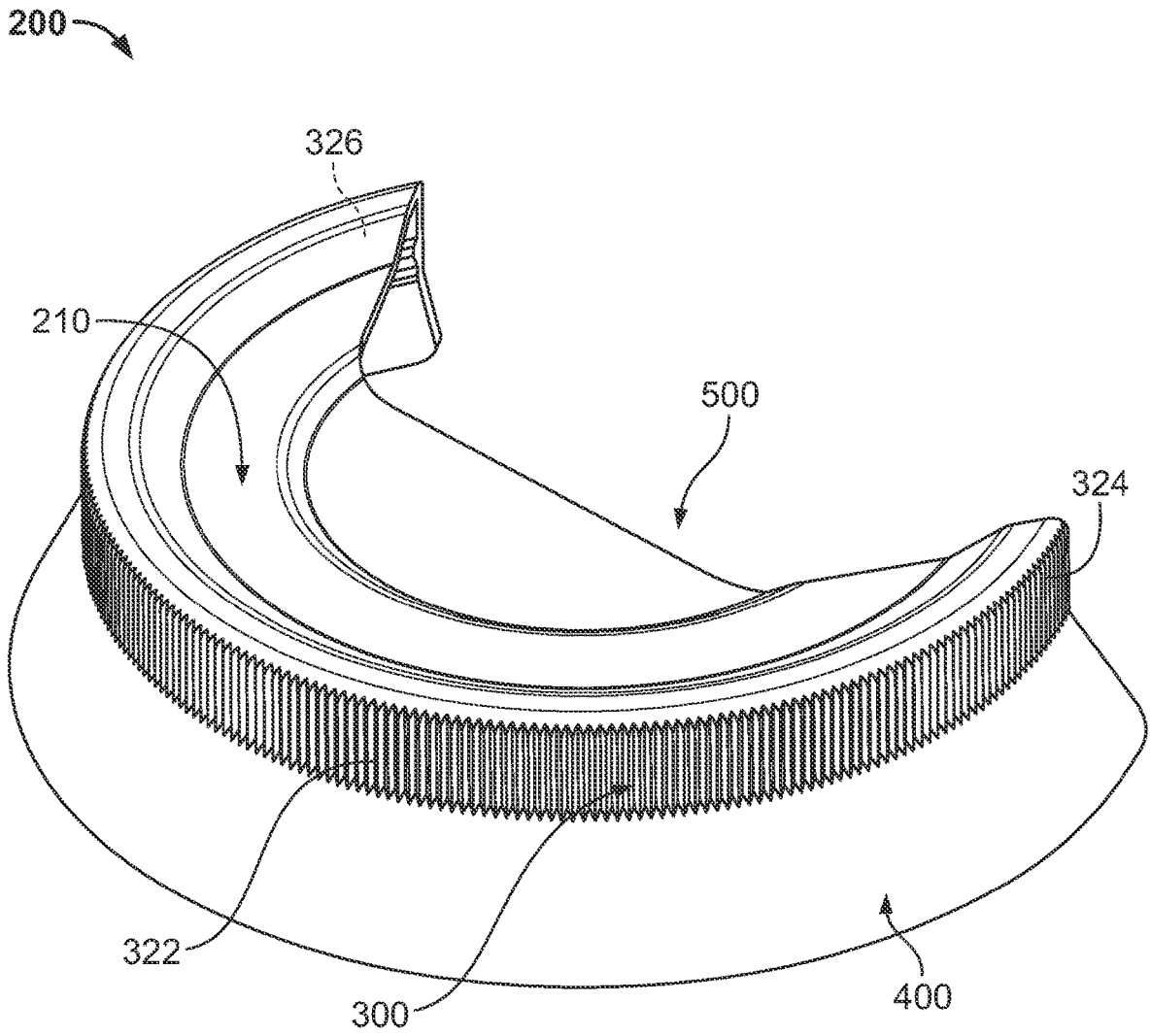
FIG. 1 shows a back left perspective view of the Rotatable Beverage Can Cover (200).

The Rotatable Beverage Can Cover (200) comprises a circular surface (210), a curved side wall (300), and a notch (500). The Rotatable Beverage Can Cover (200) may further comprise an protective conical ring (400). FIG. 1 shows a back left perspective view of the Rotatable Beverage Can Cover (200), comprising a circular surface (210), a curved side wall (300), a notch (500), and an protective conical ring (400).

(J) 2.1 Circular surface (210)

Figure 3:
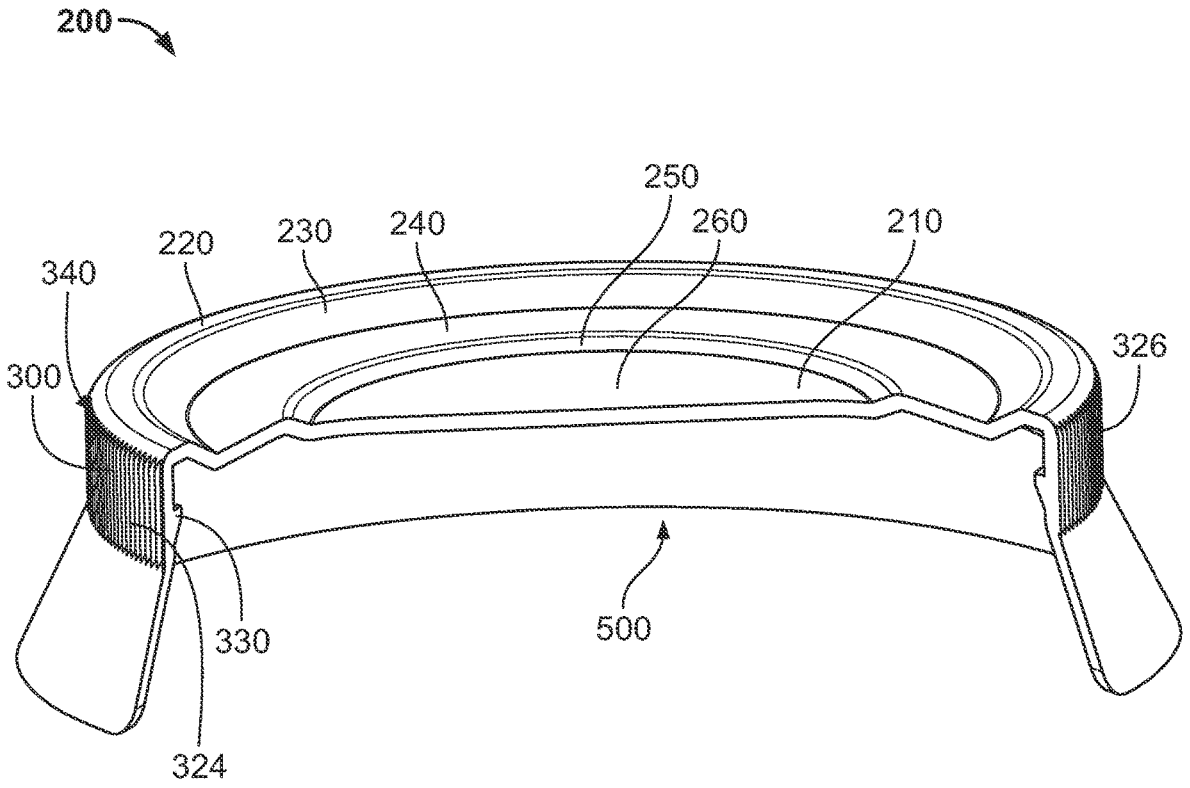
FIG. 3 shows a front center perspective view of the Rotatable Beverage Can Cover (200).

The circular surface (210) provides a physical shield from airborne and touch contaminants. This circular surface (210) prevents airborne and touch contaminants to layer over the drinking contact area (190). The circular surface (210) also prevents airborne and touch contaminants from layering over the scored area (124) that contacts the beverage (600) when the pull tab (130) pushes the scored area (124) into the beverage (600). The circular surface (210) may comprise an outer ring (220), an outer conical ring (230), an inner ring (240), an inner conical ring (250), and an inner circle (260). FIG. 3 shows the circular surface (210) comprising the outer ring (220), the outer conical ring (230), the inner ring (240), the inner conical ring (250), and the inner circle (260).

The elements of the circular surface (210) create a multi level surface design that allows the incremental pushing down of the pull tab (130) as the Rotable Beverage Can Cover (200) rotates.

Figure 4:
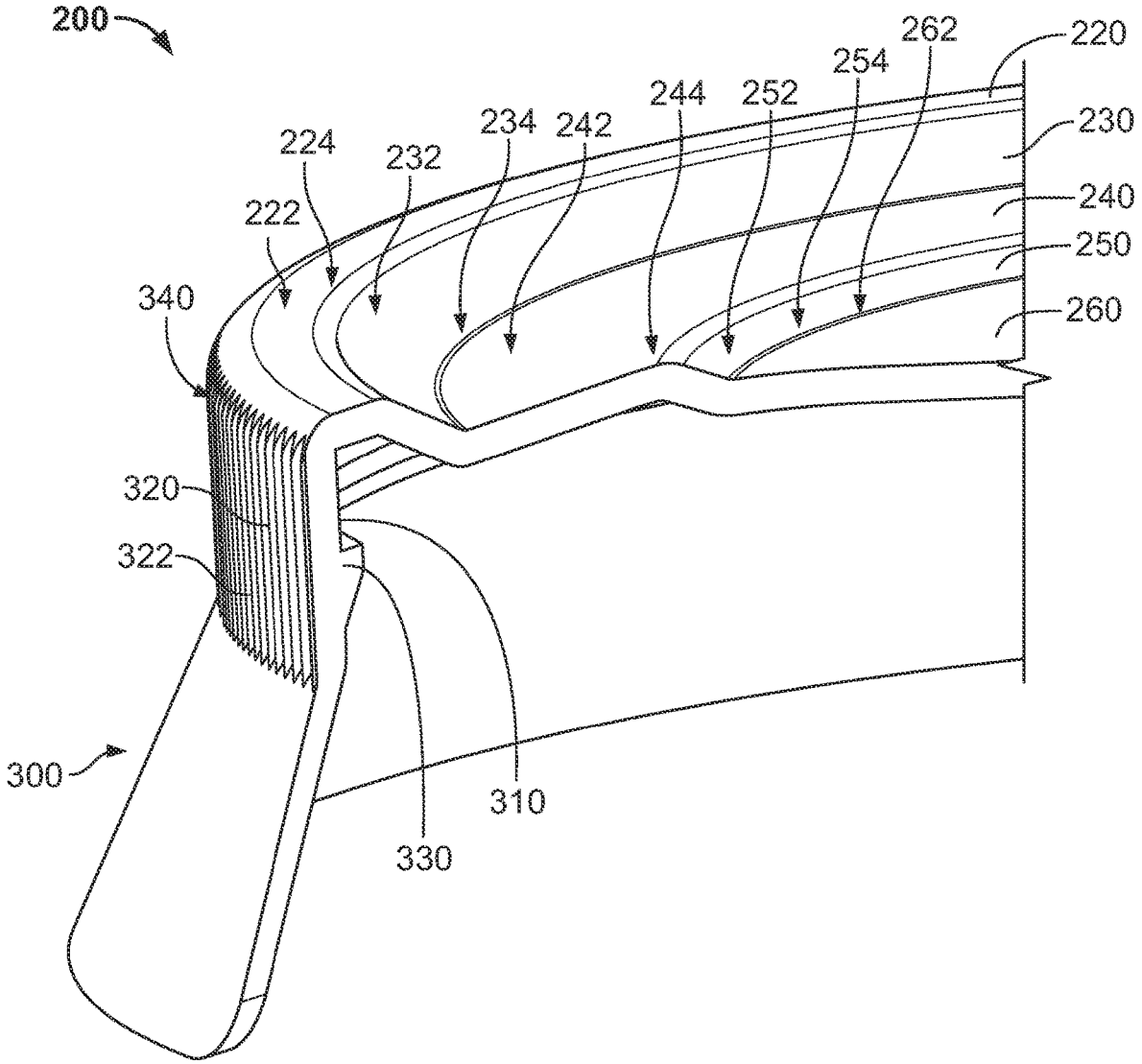
FIG. 4 shows a closeup perspective view of the front left side of the Rotatable Beverage Can Cover (200).
Figure 5:
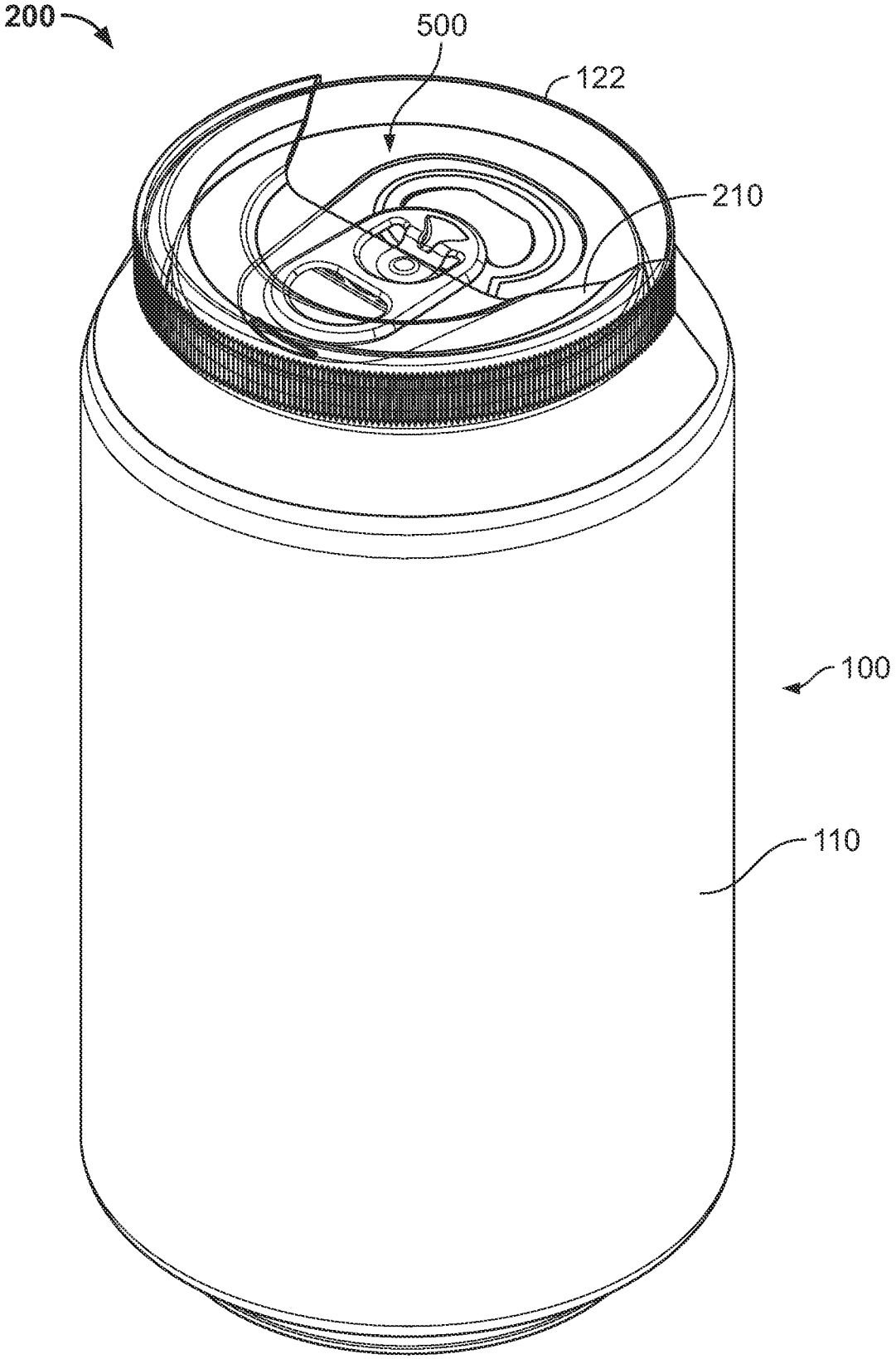
FIG. 5 shows a back left perspective view of the Rotatable Beverage Can Cover (200) fastened to the double seamed ridge (122) of the stay-on-tab beverage can (100), where the Rotatable Beverage Can Cover (200) is in its "drinking access" position. The stay-on-tab beverage can (100) is closed.

The outer ring (220) comprises an outer edge (222) and an inner edge (224). FIG. 4 shows the outer ring (220).

The outer conical ring (230) comprises an outer edge (232) and an inner edge (234). The outer edge (232) of the outer conical ring (230) is integrally joined to the inner edge (224) of the outer ring (220). The outer conical ring (230) tapers from the outer edge (232) towards the inner edge (234). FIG. 4 shows the outer conical ring (230).

The inner ring (240) comprises an outer edge (242) and an inner edge (244). The inner edge (234) of the outer conical ring (230) is integrally joined to the outer edge (242) of the inner ring (240). The inner ring (240) lies below the outer ring (220). FIG. 4 shows the inner ring (240).

The inner conical ring (250) comprises an outer edge (252) and an inner edge (254). The outer edge (252) of the inner conical ring (250) is integrally joined to the inner edge (244) of the inner ring (240). The inner conical ring (250) tapers from the outer edge (252) towards the inner edge (254). FIG. 4 shows the inner conical ring (250).

The inner circle (260) comprises a circumference (262). The circumference (262) of the inner circle (260) is integrally joined to the inner edge (254) of the inner conical ring (250). The inner circle (260) lies below the outer ring (220) and the inner ring (240). FIG. 4 shows the inner circle (260).

The outer ring (220), the outer conical ring (230), the inner ring (240), the inner conical ring (250), and the inner circle (260) are co-centric. FIG. 3 shows the outer ring (220), the outer conical ring (230), the inner ring (240), the inner conical ring (250), and the inner circle (260).

The conical shape of the outer conical ring (230) ensures that the outer ring (220) and the inner ring (240) do not share the same plane. The conical shape of the inner conical ring (250) ensures that the inner ring (240) and the inner circle (260) do not share the same plane. The conical shape of the outer conical ring (230) and the conical shape of the inner conical ring (250) ensures that the outer ring (220) and the inner circle (260) do not share the same plane. The inner circle (260) lies below the inner ring (240), and the inner ring (240) lies below the outer ring (220). FIG. 3 shows the relative positioning of the inner circle (260), the inner ring (240), and the outer ring (220).

(J) 2.2 Curved side wall (300)

The curved side wall (300) comprises an inner surface (310), an outer surface (320) and a lip (330). The curved side wall (300) fastens the Rotatable Beverage Can Cover (200) to the double seamed ridge (122) of the lid (120). The top edge (340) of the curved side wall (300) is integrally joined to the outer edge (222) of the outer ring (220) of the circular surface (210) at a substantially right angle (+/−5 degrees). FIG. 3 shows the curved side wall (300) integrally joined to the outer ring (220).

The lip (330) is joined to the inner surface (310) of the curved side wall (300). The lip (330) is oriented so that it is concentric with the curved side wall (300) and the circular surface (210). The lip (330) extends inwards from the inner surface (310) of the curved side wall (300). FIG. 4 shows the lip (330) extending inwards from the inner surface (310) of the curved side wall (300).

When the Rotatable Beverage Can Cover (200) is fastened over the lid (120) of a stay-on-tab beverage can (100), the lip (330) of the curved side wall (300) fastens underneath the double seamed ridge (122) of the lid (120). FIG. 12 shows the lip (330) fastened underneath the double seamed ridge (122) of the lid (120).

The lip (330) extends inwards from the inner surface (310) of the curved side wall (300) so that the Rotatable Beverage Can Cover (200) remains fastened to the stay-on-tab beverage can (100) within normal stay-on-tab beverage can (100) handling and transportation circumstances. In this manner, once the Rotatable Beverage Can Cover (200) is fastened to the stay-on-tab beverage can (100), it will not be dislodged, eliminating funtional and littering concerns.

Although the Rotatable Beverage Can Cover (200) is primarily intended to be an OEM item, the Rotatable Beverage Can Cover (200) may also be used for aftermarket private labeling purposes. The design of the curved side wall (300) may be changed to allow for aftermarket fastening to the stay-on-tab beverage can (100) or unfastening from the stay-on-tab beverage can (100). This would involve changing the interface between the lip (330) and the double seamed ridge (122) of the lid (120). This could be accomplished by changing the design of the lip (330), either by the length of the lip (330) or the shape of the lip (330). This would allow for a "looser" or "tighter" fit between the lip (330) and the double seamed ridge (122) of the lid (120).

The outer surface (320) may further comprise a plurality of protrusions (322). These protrusions (322) enhance the frictional characteristics of the outer surface (320) of the curved side wall (300). These protrusions (322) allow for better finger gripping of the curved side wall (300), allowing for easier rotation of the Rotatable Beverage Can Cover (200). The protrusions (322) may be formed by bumps, knurls, ridges and textures that enhance the friction between a beverage user's fingers and the outer surface (320) of the curved side wall (300).

The protrusions (322) can encompass the entirety of the outer surface (320) of the curved side wall (300). FIG. 1 shows the Rotatable Beverage Can Cover (200) with protrusions (322) along the entirety of the outer surface (320) of the curved side wall (300).

The protrusions (322) can encompass less than the entirety of the outer surface (320) of the curved side wall (300). For example, the outer surface (320) of the curved side wall (300) may further comprise a first end (324) and a second end (326), where the outer surface (320) of the curved side wall (300) comprises a plurality of protrusions (322), where some of the protrusions (322) are located at the first end (324) of the curved side wall (300) and some of the protrusions (322) are located at the second end (326) of the curved side wall (300). This allows the protursions to be present only where the fingers of the beverage drinker will be placed to rotate the Rotatable Beverage Can Cover (200). FIG. 3 shows the Rotatable Beverage Can Cover (200) where some of the protrusions (322) are located at the first end (324) of the curved side wall (300) and some of the protrusions (322) are located at the second end (326) of the curved side wall (300).

(J) 2.3 Protective conical ring (400)

The Rotatable Beverage Can Cover (200) may further comprise a protective conical ring (400). The circular surface (210) and the curved side wall (300) cover a portion of the drinking contact area (190) but does not cover a significant portion of the drinking contact area (190) associated with the top side of the beverage can body (110). The protective conical ring (400) provides sanitary protection to a portion of the drinking contact area (190) associated with the top side of the beverage can body (110).

Figure 2:
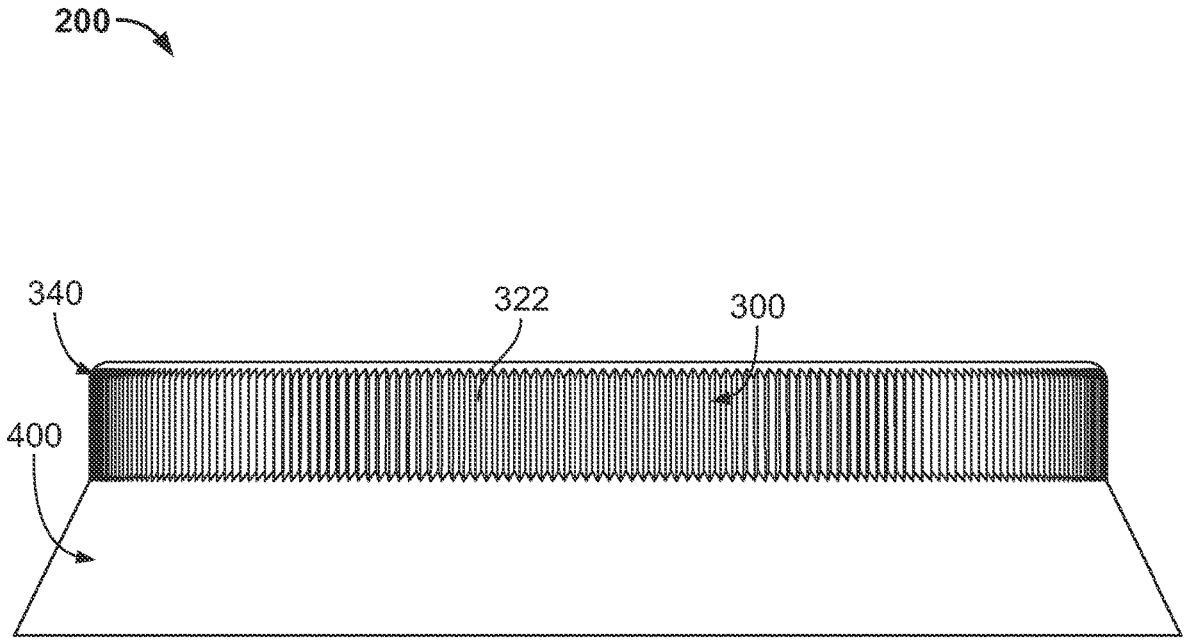
FIG. 2 shows a back view of the Rotatable Beverage Can Cover (200).

The protective conical ring (400) is integrally joined to the bottom edge (350) of the curved side wall (300) at an angle that allows the protective conical ring (400) to follow the tapered contour of the top side of the beverage can body (110). FIG. 2 shows the protective conical ring (400) integrally joined to the bottom edge (350) of the curved side wall (300) at an angle that follows the tapered contour of the top side of the beverage can body (110).

When the Rotatable Beverage Can Cover (200) is in its "sanitary protection" position, the protective conical ring (400) covers the portion of the top side of the beverage can body (110) that comes into contact with the mouth of the beverage drinker. FIG. 7 shows the Rotatable Beverage Can Cover (200) is in its "sanitary protection" position with the protective conical ring (400) covering the drinking contact area (190) associated with the beverage can body (110).

(J) 2.4 Notch (500)

The notch (500) provides access to the underlying lid (120). When the Rotatable Beverage Can Cover (200) is in its "sanitary protection position," the notch (500) on the Rotatable Beverage Can Cover (200) allows access to the pull tab area (195). When the Rotatable Beverage Can Cover (200) is in its "drinking access" position, the notch (500) allows access to the drinking contact area (190) and the scored opening (126).

The shape of the notch (500) needs to ensure that the beverage drinker has full access to the pull tab (130) so that the beverage drinker can pull the pull tab (130) from a "prone" position to an "extended" position, while the Rotatable Beverage Can Cover (200) is in its "sanitary protection position.

The shape of the notch (500) needs to ensure that the beverage drinker has full access to the scored area (124) and the scored opening (126) to ensure proper drinking of the beverage (600) within the stay-on-tab beverage can (100), while the Rotatable Beverage Can Cover (200) is in its "drinking access" position.

The shape of the notch (500) maybe that of an annular sector (510), the area enclosed within two co-planar circles and two radii of the co-planar circles. The co-planar circles may be concentric or not concentric. FIG. 11 shows the shape of the notch (500) as an annular sector (510). The shape of the notch (500) maybe that of a semi-annular sector (520), the area enclosed within a circle, a quadrilateral enclosed by the circle, and two line segments that connect the circle to the quadrilateral. FIG. 9 shows the shape of the notch (500) as a semi-annular sector (520).

The choice of an annular sector or a semi-annular sector allows the circular surface (210) of the Rotatable Beverage Can Cover (200) to have a larger surface area and to have a larger perimeter. The larger surface area allows for the circular surface (210) to cover more of the lid (120). The larger perimeter of the circular surface (210) allows for a larger perimeter curved side wall (300); a longer curved side wall (300) allows the beverage drinker's fingers to be spread apart and be better positioned to generate increased torque to rotate the Rotatable Beverage Can Cover (200) around the stay-on-tab beverage can (100).

Having a notch (500) with merely a semi circular shape limits that surface area of the circular surface (210) and the perimeter of the curved side wall (300). The shorter perimeter of the curved side wall (300) does not allow for the beverage drinker's fingers to generate enough torque to easily rotate the Rotatable Beverage Can Cover (200) around the stay-on-tab beverage can (100).

(J) 3 Rotatable Beverage Can Cover (200) Usage

The Rotatable Beverage Can Cover (200) is fastened to the stay-on-tab beverage can (100) and placed in its "sanitary protection" position so that: a) the Rotatable Beverage Can Cover (200) covers the drinking contact area (190) and b) the notch (500) on the Rotatable Beverage Can Cover (200) allows access to the pull tab area (195).

The beverage drinker accesses the pull tab (130) through the notch (500) and moves the pull tab (130) from its "prone" position to its "extended" position. As the pull tab (130) moves to its "extended" position, the pull tab (130) pushes down the scored area (124), creating a scored opening (126) on the circular surface (210) of the Rotatable Beverage Can Cover (200).

The beverage drinker places his/her fingers over the outer surface (320) of the curved side wall (300). If the outer surface (320) of the curved side wall (300) further comprises protrusions (322), the beverage drinker would place his/her fingers over the protrusions (322) of the outer surface (320) for a better grip and rotation of the Rotatable Beverage Can Cover (200).

The beverage drinker then rotates the Rotatable Beverage Can Cover (200) either clockwise or counter-clockwise to move the Rotatable Beverage Can Cover (200) from its "sanitary protection" position to its "drinking access" position so that: a) the circular surface (210) of the Rotatable Beverage Can Cover (200) covers the pull tab area (195): and b) the notch (500) allows access to the drinking contact area (190) and the scored opening (126).

Once the beverage drinker has opened the stay-on-tab beverage can (100) and created a scored opening (126) on the circular surface (210), the pull tab (130) may remain in its "extended" position or remain at a certain percentage of its "extended" position, depending whether the beverage drinker has pushed down the pull tab (130) (collectively "open" position). As the Rotatable Beverage Can Cover (200) rotates from its "sanitary protection" position to its "drinking access" position, the circular surface (210) of the Rotatable Beverage Can Cover (200) comes into contact with the pull tab (130) in its "open" position. The multi level surface design of the circular surface (210) ensures that the pull tab (130) folds down from its "open" position back to substantially its "prone" position underneath the circular surface (210) without further intervention of the beverage drinker.

The shape of the notch (500) ensures that the pull tab (130) comes into contact with the various elements of the circular surface (210) in a sequential and systematic manner, incrementally pushing down the pull tab (130) underneath the circular surface (210) due to the multi level surface design of the circular surface (210), as the Rotatable Beverage Can Cover (200) rotates from its "sanitary protection" position to its "drinking access" position.

1. As the pull tab (130) comes into contact with the circular surface (210), the pull tab (130) may come into contact with the outer ring (220) of the circular surface (210). The outer ring (220) pushes down the pull tab (130) a certain amount as the Rotatable Beverage Can Cover (200) rotates.
2. As the Rotatable Beverage Can Cover (200) continues to rotate, the pull tab (130) may come into contact with the outer conical ring (230). The outer conical ring (230) pushes down the pull tab (130) a certain amount as the Rotatable Beverage Can Cover (200) rotates.
3. As the Rotatable Beverage Can Cover (200) continues to rotate, the pull tab (130) may come into contact with the inner ring (240). The inner ring (240) pushes down the pull tab (130) a certain amount as the Rotatable Beverage Can Cover (200) rotates.
4. As the Rotatable Beverage Can Cover (200) continues to rotate, the pull tab (130) may come into contact with the inner conical ring (250). The inner conical ring (250) pushes down the pull tab (130) a certain amount as the Rotatable Beverage Can Cover (200) rotates.
5. As the Rotatable Beverage Can Cover (200) continues to rotate, the inner circle (260) pushes down the pull tab (130) a certain amount to substantially its "prone" position where the pull tab (130) is completely underneath the circular surface (210).

By having the pull tab (130) pushed down from its "open" position to its "prone" position without further intervention of the beverage drinker, it simplifies the usage and adoption of the Rotatable Beverage Can Cover (200).

The multi level surface design of the circular surface (210) ensures that the pull tab (130) is pushed down incrementally rather than getting stuck in its "open" position and preventing the Rotatable Beverage Can Cover (200) from rotating.

(J) 4 Clarifying Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should therefore not be limited by the above described embodiment, process, and examples, but by all embodiments and processes within the scope and spirit of the invention.

The inventions shown and described herein may be used to address one or more of such problems or other problems not set out herein and/or which are only understood or appreciated at a later time. The future may also bring to light currently unknown or unrecognized benefits which may be appreciated, or more fully appreciated, in association with the inventions shown and described herein. The desires and expected benefits explained herein are not admissions that others have recognized such prior needs, since invention and discovery are both inventive under the law and may relate to the inventions described herein.

I claim:

1. A beverage can cover that is rotatably fastened to a double seamed ridge created by a lid and a body of a beverage can, where the lid has an area where a scored opening is created when a pull tab of the beverage can is pulled, the beverage can cover comprising:

(a) a circular surface;

(b) a curved side wall;

(c) a notch;

(d) where the curved sidewall is joined to the circular surface;

(e) where the notch extends on the curved side wall and the circular surface, (f) where the circular surface covers the area of the lid of the beverage can where the scored opening created when the pull tab of the beverage can is pulled and where the notch provides access to the pull tab, (g) where the beverage can cover rotates around the double seamed ridge so that the circular surface covers a portion of the pull tab and the notch provides access to the scored opening.

2. The beverage can cover described in claim 1, (a) where the notch is the shape of an annular sector.

3. The beverage can cover described in claim 1, (a) where the notch is the shape of a semi-annular sector.

4. The beverage can cover described in claim 1, (a) the beverage can cover further comprising:

(i) a protective conical ring;

(b) wherein the curved side wall further comprises:

(i) a top edge; and (ii) a bottom edge;

(c) where the protective conical ring is joined to the bottom edge of the curved side wall, (d) where the protective conical ring covers a portion of the body of the beverage can.

5. The beverage can cover described in claim 1, (a) wherein the circular surface further comprises:

(i) an outer ring, the outer ring comprising:

(1) an outer edge;

(2) an inner edge;

(ii) an outer conical ring; the outer conical ring comprising:

(1) an outer edge;

(2) an inner edge;

(iii) an inner ring, the inner ring comprising:

(1) an outer edge;

(2) an inner edge;

(iv) an inner conical ring; the inner conical ring comprising:

(1) an outer edge;

(2) an inner edge;

(v) an inner circle, the inner circle comprising:

(1) a circumference;

(vi) where the inner conical ring joins the circumference of the inner circle to the inner edge of the inner ring;

(vii) where the outer conical ring joins the inner edge of the outer ring to the outer edge of the inner ring;

(b) wherein the curved side wall further comprises:

(i) an outer surface;

(ii) an inner surface;

(iii) a lip, where the lip is joined to the inner surface of the curved side wall, where the lip is concentric to the curved side wall and the circular surface, (iv) where the curved side wall is joined to the outer edge of the outer ring at a right angle, (c) where the curved side wall and the lip of the curved side wall are rotatably secured to the top of the beverage can, allowing for the covering of the opening of the beverage can by rotating the beverage can cover.

6. The beverage can cover described in claim 5,
(a) wherein the curved side wall further comprises:
(i) a first end;
(ii) a second end;
(b) wherein the outer surface of the sidewall comprising:
(i) a plurality of protrusions;
(ii) where some of the protrusions are located at the first end of the curved side wall,
(iii) where some of the protrusions are located at the second end of the curved side wall.

7. The beverage can cover described in claim 6,
(a) wherein the protrusions are in the shape of ridges.

8. The beverage can cover described in claim 6,
(a) the beverage can cover further comprising:
(i) a protective conical ring;
(b) wherein the curved side wall further comprises:
(i) a top edge; and
(ii) a bottom edge;
(c) where the protective conical ring is joined to the bottom edge of the curved side wall,
(d) where the protective conical ring covers a portion of the body of the beverage can.

9. The beverage can cover described in claim 8,
(a) where the notch is the shape of an annular sector,
(i) where the notch extends on the curved side wall, the outer ring, the outer conical ring, the inner ring, the inner conical ring, and the inner circle.

10. The beverage can cover described in claim 8,
(a) where the notch is the shape of a semi-annular sector,
(i) where the notch extends on the curved side wall, the outer ring, the outer conical ring, the inner ring, the inner conical ring, and the inner circle.

* * * * *